US007109644B2

(12) United States Patent
Smith et al.

(10) Patent No.: US 7,109,644 B2
(45) Date of Patent: Sep. 19, 2006

(54) DEVICE AND METHOD FOR FABRICATION OF MICROCHANNEL PLATES USING A MEGA-BOULE WAFER

(75) Inventors: Arlynn Walter Smith, Blue Ridge, VA (US); Warren D. Vrescak, Roanoke, VA (US); Nelson Christopher DeVoe, Roanoke, VA (US); Steve David Rosine, Roanoke, VA (US); William Allen Smith, Daleville, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 201 days.

(21) Appl. No.: 10/727,761

(22) Filed: Dec. 3, 2003

(65) Prior Publication Data

US 2005/0122022 A1 Jun. 9, 2005

(51) Int. Cl.
*H01J 43/00* (2006.01)

(52) U.S. Cl. ..... 313/103 CM; 385/115; 385/116; 385/120; 250/214 VT

(58) Field of Classification Search ..... 313/103 CM, 313/105 CM, 523, 532, 538; 385/115–118, 385/120; 250/207, 214 VT
See application file for complete search history.

(56) References Cited

U.S. PATENT DOCUMENTS 3,979,637 A * 9/1976 Siegmund ..... 315/12.1
4,912,314 A 3/1990 Sink
5,990,601 A * 11/1999 Orthuber et al. ..... 313/105 CM
6,064,055 A 5/2000 Dorko

* cited by examiner

*Primary Examiner*—Nimesh Patel
*Assistant Examiner*—Anthony Canning
(74) *Attorney, Agent, or Firm*—RatnerPrestia

(57) ABSTRACT

The present invention provides a mega-boule for use in fabricating microchannel plates (MCPs). The mega-boule includes a cross-sectional surface having at least first, second and third areas, each area occupying a distinct portion of the cross-sectional surface. The first and second areas include a plurality of optical fibers, transversely oriented to the cross-sectional surface, each optical fiber having a cladding formed of non-etchable material and a core formed of etchable material. The third area is disposed interstitially between and surrounding the first and second areas, and includes non-etchable material.

14 Claims, 5 Drawing Sheets

DEVICE AND METHOD FOR FABRICATION OF MICROCHANNEL PLATES USING A MEGA-BOULE WAFER

TECHNICAL FIELD

The present invention relates to microchannel plates (MCPs) for use with image intensifiers, and more specifically, to a device and method for fabrication of multiple MCPs using a mega-boule wafer.

BACKGROUND OF THE INVENTION

Microchannel plates are used as electron multipliers in image intensifiers. They are thin glass plates having an array of channels extending there through and are located between a photocathode and a phosphor screen. An incoming electron from the photocathode enters the input side of the microchannel plate and strikes a channel wall. When voltage is applied across the microchannel plate, these incoming or primary electrons are amplified, generating secondary electrons. The secondary electrons then exit the channel at the back end of the micrcochannel plate and are used to generate an image on the phosphor screen.

In general, fabrication of a microchannel plate starts with a fiber drawing process, as disclosed in U.S. Pat. No. 4,912,314, issued Mar. 27, 1990 to Ronald Sink, which is incorporated herein by reference in its entirety. For convenience, FIGS. 1–4, disclosed in U.S. Pat. No. 4,912,314, are included herein and discussed below.

In FIG. 1 there is shown a starting fiber 10 for the microchannel plate. Fiber 10 includes glass core 12 and glass cladding 14 surrounding the core. Core 12 is made of glass material that is etchable in an appropriate etching solution. Glass cladding 14 is made from glass material which has a softening temperature substantially the same as the glass core. The glass material of cladding 14 is different from that of core 12, however, in that it has a higher lead content, which renders the cladding non-etchable under the same conditions used for etching the core material. Thus, cladding 14 remains after the etching of the glass core. A suitable cladding glass is a lead-type glass, such as Corning Glass 8161.

The optical fibers are formed in the following manner: An etchable glass rod and a cladding tube coaxially surrounding the rod are suspended vertically in a draw machine which incorporates a zone furnace. The temperature of the furnace is elevated to the softening temperature of the glass. The rod and tube fuse together and are drawn into a single fiber 10. Fiber 10 is fed into a traction mechanism in which the speed is adjusted until the desired fiber diameter is achieved. Fiber 10 is then cut into shorter lengths of approximately 18 inches.

Several thousands of the cut lengths of single fiber 10 are then stacked into a graphite mold and heated at a softening temperature of the glass to form hexagonal array 16, as shown in FIG. 2. As shown, each of the cut lengths of fiber 10 has a hexagonal configuration. The hexagonal configuration provides a better stacking arrangement.

The hexagonal array, which is also known as a multi assembly or a bundle, includes several thousand single fibers 10, each having core 12 and cladding 14. Bundle 16 is suspended vertically in a draw machine and drawn to again decrease the fiber diameter, while still maintaining the hexagonal configuration of the individual fibers. Bundle 16 is then cut into shorter lengths of approximately 6 inches.

Several hundred of the cut bundles 16 are packed into a precision inner diameter bore glass tube 22, as shown in FIG. 3. The glass tube has a high lead content and is made of a glass material similar to glass cladding 14 and is, thus, non-etchable by the etching process used to etch glass core 12. The lead glass tube 22 eventually becomes a solid rim border of the microchannel plate.

In order to protect fibers 10 of each bundle 16, during processing to form the microchannel plate, a plurality of support structures are positioned in glass tube 22 to replace those bundles 16 which form the outer layer of the assembly. The support structures may take the form of hexagonal rods of any material having the necessary strength and the capability to fuse with the glass fibers. Each support structure may be a single optical glass fiber 24 having a hexagonal shape and a cross-sectional area approximately as large as that of one of the bundles 16. The single optical glass fiber, however, has a core and a cladding which are both non-etchable. The optical fibers 24, or support rods 24, are illustrated in FIG. 3, as being disposed at the periphery of assembly 30 and surrounding the plurality of bundles 16.

The support rods may be formed from one optical fiber or any number of fibers up to several hundred. The final geometric configuration and outside diameter of one support rod 24 is substantially the same as one bundle 16. The multiple fiber support rods may be formed in a manner similar to that of forming bundle 16.

Each bundle 16 that forms the outermost layer of fibers in tube 22 is replaced by a support rod 24. This is preferably done by positioning one end of a support rod 24 against one end of a bundle 16 and then pushing support rod 24 against bundle 16, until bundle 16 is out of tube 22. The assembly formed when all of the outer bundles 16 have been replaced by support rods 24 is called a boule, and is generally designated as 30 in FIG. 3.

Boule 30 is fused together in a heating process to produce a solid boule of rim glass and fiber optics. The fused boule is then sliced, or diced, into thin cross-sectional plates. The planar end surfaces of the sliced fused boule are ground and polished.

In order to form the microchannels, cores 12 of optical fibers 10 are removed, by etching with dilute hydrochloric acid. After etching the boule, the high lead content glass claddings 14 remains to form microchannels 32, as illustrated in FIG. 4. Also, support rods 24 remain solid and provide a good transition from the solid rim of tube 22 to microchannels 32.

Additional process steps include beveling and polishing of the glass boule. After the plates are etched to remove the core rods, the channels in the boule are metallized and activated.

As described, the current method of manufacturing an MCP includes stacking multiple bundles, and then placing the stacked bundles within a sheath of rim glass. The supporting rods of non-etchable fibers are then used to fill the interstitial space between the bundles of etchable fibers and the rim glass (tube 22) to form a boule. The boule is then sliced at an angle into thin wafers to produce a bias angle. The wafers are then etched, hydrogen fired to form a conduction layer, and metallized to provide electrical contact.

After the boule is sliced into wafers, each wafer is handled individually. A typical size of the wafer is approximately 1 inch diameter. This is much smaller than the wafer size of current semiconductor processing tools and necessitates use of custom fabrication processing tools. Handling each boule wafer individually leads to large amounts of touch labor for a part very sensitive to particle contamination. The yield of these wafers are, therefore, reduced.

The present invention addresses the need for fabricating MCPs using more efficient fabrication methods and for methods that are less subject to contamination and reduced yield.

SUMMARY OF THE INVENTION

To meet this and other needs, and in view of its purposes, the present invention provides a mega-boule for use in fabricating microchannel plates (MCPs). The mega-boule includes a cross-sectional surface having at least first, second and third areas, each area occupying a distinct portion of the cross-sectional surface. The first and second areas include a plurality of optical fibers, transversely oriented to the cross-sectional surface, each optical fiber having a cladding formed of non-etchable material and a core formed of etchable material. The third area is disposed interstitially between and surrounding the first and second areas, and includes non-etchable material.

In another aspect, the invention includes a method of forming a plurality of microchannel plates (MCPs). The method includes the steps of: (a) providing a bundle of optical fibers, wherein each optical fiber includes a cladding formed of non-etchable material and a core formed of etchable material; (b) stacking a plurality of the bundles to form at least first and second cross-sectional areas, defining first and second mini-boules, respectively; (c) stacking non-etchable material interstitially between and surrounding the at least first and second mini-boules; and (d) fusing the plurality of bundles and the stacked non-etchable material for forming the plurality of MCPs in the at least first and second cross-sectional areas.

The method may also include the steps of: (e) dicing the fused bundles and non-etchable material to form multiple mega-boule wafers, each mega-boule wafer defining a batch die; (f) activating, and metallizing each mega-boule wafer for forming the plurality of MCPS; and (g) extracting from each mega-boule wafer the plurality of MCPs.

In yet another aspect, the invention includes a method of forming a batch die for forming multiple microchannel plates (MCPs). The method includes the steps of: (a) providing etchable and non-etchable optical materials; and (b) stacking the etchable and non-etchable optical materials to form a stack having a cross-sectional surface including at least first, second and third areas. The first and second areas are stacked with the etchable optical material and the third area is stacked with the non-etchable optical material, and the third area is disposed interstitially between and surrounding the first and second areas. The method may also include forming the first, second and third areas distinctly and separately from each other.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

Figure 5:
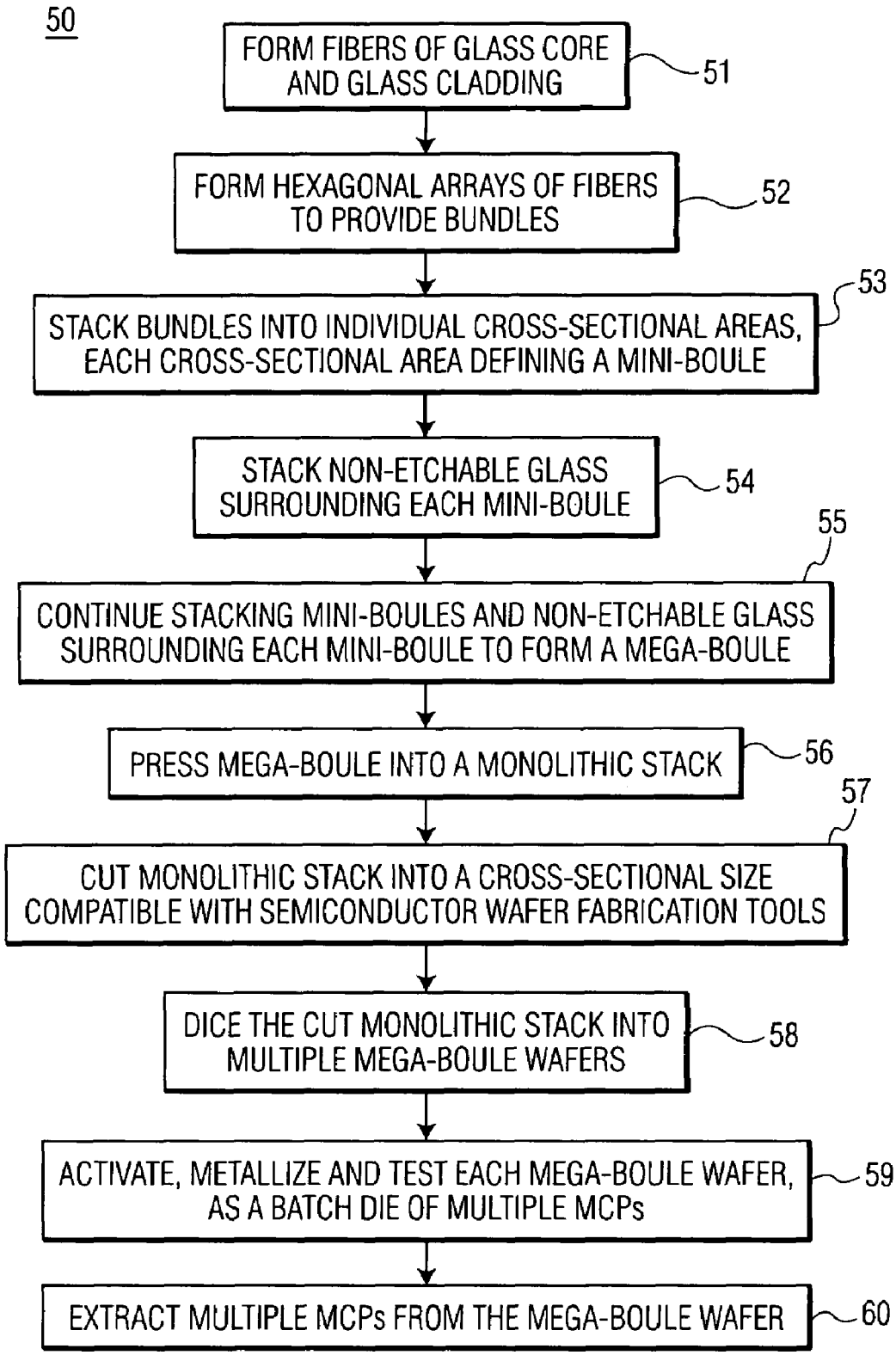
FIG. 5 is a flow diagram illustrating a method for fabricating microchannel plates using a mega-boule wafer, in accordance with the present invention.

The present invention relates to forming a plurality of MCPs by using a method amenable to conventional wafer fabrication tools. More specifically, an embodiment of a method of the present invention is shown in FIG. 5, and is generally designated by reference numeral 50. As will be explained, the method forms a batch die for making multiple MCPs from a single large wafer. The single large wafer, referred to as a mega-boule wafer, is sized to be accommodated by conventional wafer fabrication tools.

Figure 1:
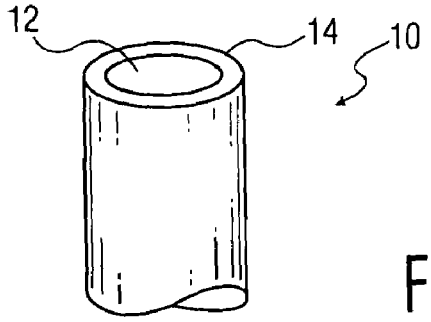
FIG. 1 is a partial view of a fiber used in fabricating microchannel plates in accordance with the present invention.

Referring now to FIG. 5 and beginning with step 51, fibers of glass core and glass cladding are formed by method 50. Starting fiber 10 is shown in FIG. 1 and includes glass core 12 and glass cladding 14. Core 12 is made of material that is etchable, so that the core may be subsequently removed by etching a mega-boule wafer, in accordance with the present invention. Glass cladding 14 is made of glass that is non-etchable under the same conditions that allow etching of core 12. Thus, each cladding remains after the etching process, and becomes a boundary for a microchannel that forms upon removal of a corresponding core.

As discussed before, a suitable cladding glass is a lead-type glass, such as Corning Glass 8161. In subsequent stages of the inventive process, using conventional fabrication tools on the mega-boule wafer, the lead oxide is reduced to activate the inner surfaces of each of the glass claddings, so that they are capable of emitting secondary electrons.

As described in U.S. Pat. No. 4,912,314, which is incorporated herein by reference in its entirety, optical fibers 10 are formed in the following manner: An etchable glass rod and a cladding tube coaxially surrounding the glass rod are suspended vertically in a draw machine which incorporates a zone furnace. The temperature of the furnace is elevated to the softening temperature of the glass. The rod and tube fuse together and are drawn into a single fiber 10. The fiber is fed into a traction mechanism, where the speed is adjusted until the desired fiber diameter is achieved. Fiber 10 is then cut into shorter lengths of approximately 18 inches.

Figure 2:
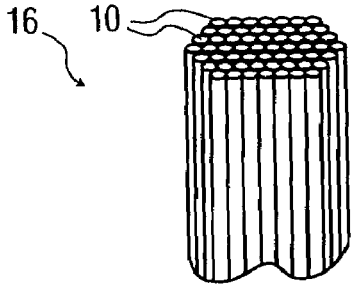
FIG. 2 is a partial view of a bundle of fibers shown in FIG. 1 for use in fabricating microchannel plates in accordance with the present invention.

The method next enters step 52 and forms multiple hexagonal arrays of fibers 10 to define multiple bundles 16, as shown in FIG. 2. Several thousands of the cut lengths of a single fiber 10 are stacked into a graphite mold and heated at the softening temperature of the glass in order to form each hexagonal array, wherein each of the cut lengths of fiber 10 has a hexagonal configuration. It will be appreciated that the hexagonal configuration provides a better stacking arrangement. In addition to the hexagonal configuration, other configurations may also be used, such as a triangular configuration and a rhombohedral configuration.

The hexagonal array 16, which is also referred to as a multi assembly or as a bundle, includes several thousand single fibers 10, each having core 12 and cladding 14. This bundle 16 is suspended vertically in a draw machine and drawn to again decrease the fiber diameter while still maintaining the hexagonal configuration of the individual fibers. The bundle 16 is then cut into shorter lengths of approximately 6 inches.

Several hundred of the cut bundles 16 are then stacked by step 53 of the inventive method to form individual larger stacks, each having a predetermined cross-sectional area. Each larger stack of the predetermined cross-sectional area containing the bundles is referred to herein as a mini-boule. The stacking continues in steps 54 and 55 by also stacking non-etchable glass (also referred to herein as support rods) so that the non-etchable glass surrounds each mini-boule. Multiple mini-boules may be stacked together, and multiple support rods may be stacked between the mini-boules and stacked to surround the peripheries of each of the mini-boules. In this manner, each mini-boule is separated from each other mini-boule by the support rods. The stacking may continue in this manner, until a cross-sectional area of a predetermined size is reached. The predetermined cross-sectional size is a function of a size that may be accommodated by conventional wafer fabrication tools. The multiple mini-boules and the interstitially placed support rods are referred to herein as a mega-boule.

Figure 6:
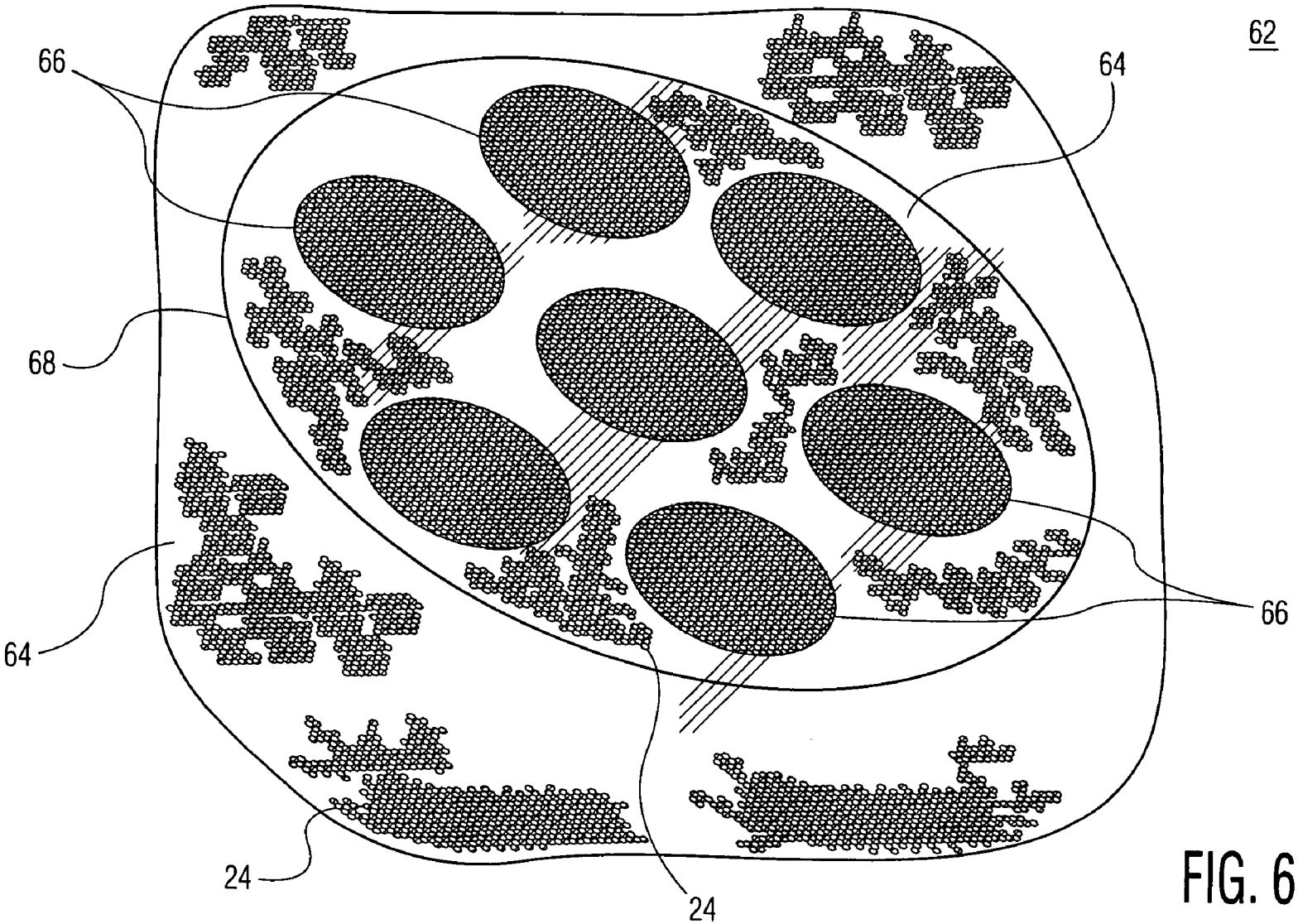
FIG. 6 is a cross-sectional view of a monolithic stack, including a cross-sectional view of a mega-boule cut from the monolithic stack, in accordance with the present invention.

As best shown in FIG. 6, mega-boule 62 includes multiple mini-boules 66 with interstitial area 64 comprised of multiple non-etchable support rods. The non-etchable support rods separate and surround each mini-boule 66. The non-etchable support rod 24 has a high lead content and is made of a glass material which is similar to glass cladding 14 and is, thus, non-etchable by the process used to etch away glass core 12. The non-etchable glass has a coefficient of expansion which is approximately the same as that of fibers 10. The non-etchable glass of support rods 24, after the method of the invention is completed, eventually becomes a solid rim border of each fabricated microchannel plate.

It will be appreciated that the non-etchable support rods provide a support structure to protect each mini-boule 66. Each support rod may take the form of a hexagonal rod (for example) of any material having the necessary strength and the capability to fuse with the etchable glass fibers. The material of the support rods have a temperature coefficient close enough to that of the etchable glass fibers to prevent distortion of the latter during temperature changes.

Figure 3:
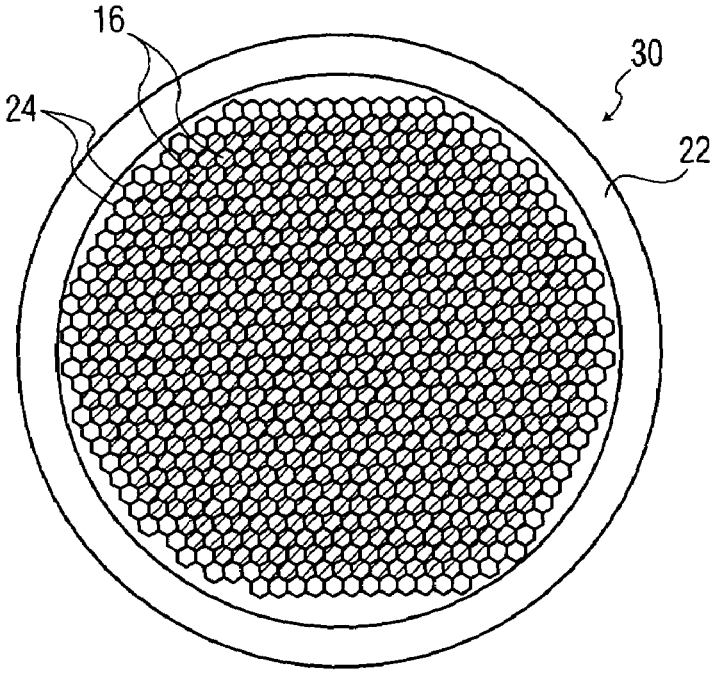
FIG. 3 PRIOR ART
FIG. 3 is a cross-sectional view of a packed boule in accordance with the prior art.

In one embodiment, each support rod may be a single optical glass fiber 24 (FIGS. 3 and 6) of hexagonal shape (for example) and of cross-sectional area approximately as large as that of one of the bundles 16. Of course, the single optical fiber may have a core and a cladding which are both non-etchable under the aforementioned conditions. The optical support fibers 24 are schematically illustrated in FIG. 6. Both the core and the cladding of support rods 24 are made of the same high lead content glass material as the material of glass claddings 14 of fibers 10. These support rods 24 form a cushioning layer and a separation space between each mini-boule 66 formed on mega-boule 62.

In other embodiments of the invention, the support rods may have a cross sectional shape other than an hexagonal shape, so long as the resulting shape of the support rods does not produce interstitial voids. For example, support rods having a triangular shape or a rhombohedral shape are likely not to result in interstitial voids. Accordingly, these shapes may also be used.

The glass rod and tube which forms the core and the cladding of support rod 24 are suspended in a draw furnace and heated to fuse the rod and tube together, and to soften the fused rod and tube sufficiently to form each support rod 24. The so formed support rod 24 is then cut into lengths of approximately 18 inches and subjected to a second draw to achieve the desired geometric configuration and smaller outside cross-sectional diameter that is substantially the same as the outside cross-sectional diameter of bundle 16. The support rods may also be formed from one optical fiber or any number of optical fibers up to several thousand fibers. The final geometric configuration and outside diameter of one support rod being substantially the same as one bundle 16. It will be appreciated that the support rods may be replaced by any other glass rods of any size and shape, so long as the support rods are of material that is non-etchable and able to fuse upon heating with the etchable bundles.

Figure 9:
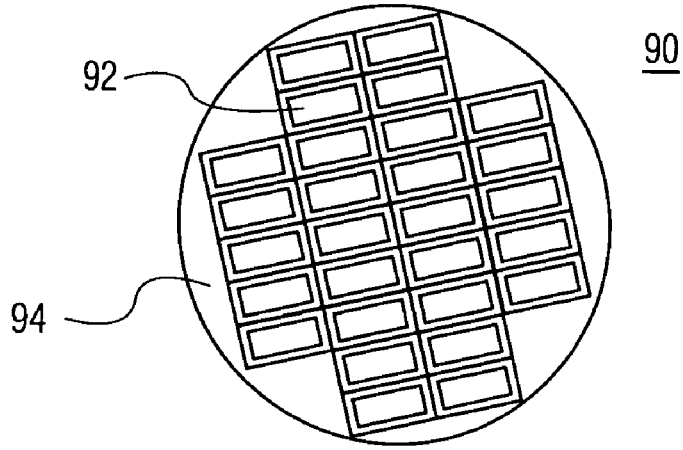
FIG. 9 is a cross-sectional view of a 4-inch semiconductor mega-boule wafer, illustrating that 28 rectangular MCPs may be extracted from the batch die, in accordance with the present invention.

It will be appreciated that the cross-sectional area of mini-boule 66 may be stacked, as large as desired by a user, for providing a corresponding individual MCP of a predetermined active cross-sectional area. It will also be appreciated that the cross-sectional area of mini-boule 66 may define a circular surface, as shown in FIG. 6, or a cross-sectional area defining a different geometry, such as a rectangular surface, as shown in FIG. 9.

After stacking the mega-boule to have a cross-sectional area of a predetermined size, the mega-boule is pressed into a monolithic stack in step 56. The pressing step may be performed, while mega-boule 62 is suspended in a furnace. The furnace may be heated at an elevated temperature, so that bundles 16 of mini-boules 66 and support rods 24 of interstitial area 64 are softened. While mega-boule 62 is at its softening temperature point, the pressing step is effective in causing bundles 16 and non-etchable rods 24 (support fibers 24) to fuse together and form a monolithic stack.

Figure 10A:
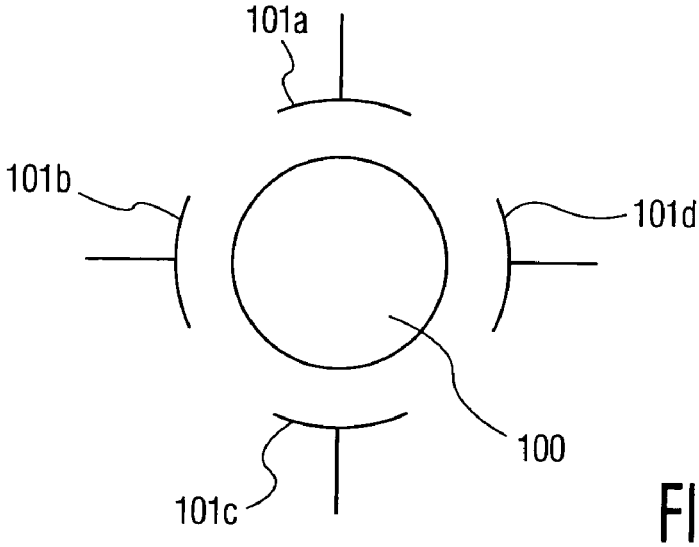
FIG. 10A is a schematic cross-sectional view of opposing arched-presses configured to press the monolithic stack of FIG. 6 into a circular geometry, in accordance with the present invention.
Figure 10B:
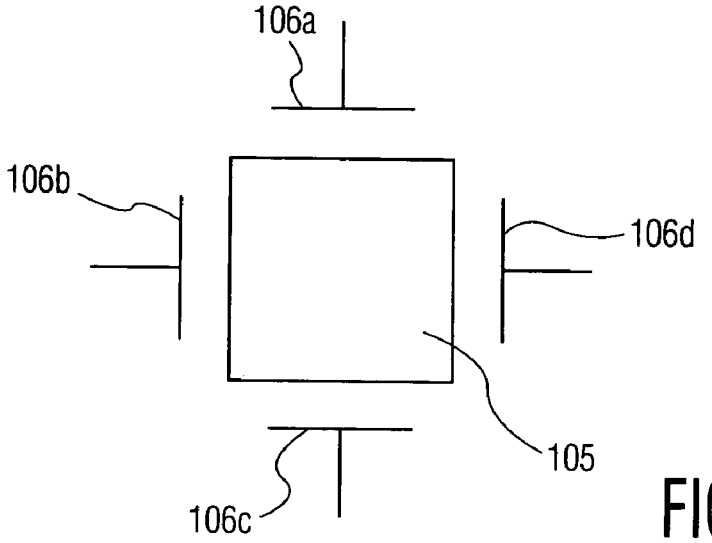
FIG. 10B is a schematic cross-sectional view of opposing linear presses configured to press the monolithic stack of FIG. 6 into a rectangular geometry, in accordance with the present invention.

It will also be appreciated that the cross-sectional area of the monolithic stack may be circular, rectangular, or of any other geometry compatible with semiconductor wafer fabrication tools. For example, mega-boule 62 may be stacked to form a substantially circular cross-sectional geometry and, subsequently, pressed into a circular monolithic stack 100 by opposing arched-presses 101*a*–101*d*, as exemplified in FIG. 10A. As another example, mega-boule 62 may be stacked to form a substantially rectangular cross-sectional geometry and, subsequently, pressed into a rectangular monolithic stack 105 by opposing linear-presses 106*a*–106*d*, as exemplified in FIG. 10B.

After the mega-boule is pressed into a monolithic stack, the pressed monolithic stack (100 or 105) is cut, in step 57, to form a cross-sectional size compatible with semiconductor wafer fabrication tools. For example, the monolithic stack may be turned on a lathe, or some other machine, to produce a circular mega-boule of circumference 68, as shown in FIG. 6.

Figure 11:
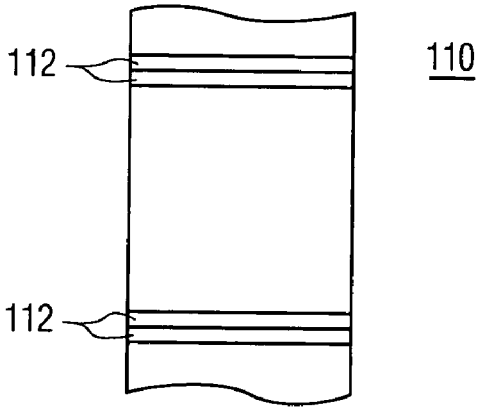
FIG. 11 is a side view of the monolithic stack of FIG. 6 being diced into multiple mega-boule wafers, in accordance with the present invention.

The cut monolithic stack is then sliced or diced, in step 58, into multiple mega-boule wafers, as schematically depicted in FIG. 11. As shown, monolithic stack 110 is diced cross-sectionally to produce a plurality of mega-boule wafers 112. Each mega-boule wafer 112 is now ready to be processed as a large batch die containing multiple MCPs. It will be appreciated that the large batch die (mega-boule wafer 112) is processed in the same manner as an individual MCP wafer is processed. Advantageously, however, the large batch die allows multiple MCPs to be concurrently produced with minimal human handling and contamination.

The method of the invention then takes each mega-boule wafer, formed by dicing in step 58, for further processing during step 59. The mega-boule wafer is heated and etched to remove the glass cores (cores 12 in FIG. 1). Since the glass claddings (claddings 14 in FIG. 1) and the support glass fibers, or the support rods (rods 24 in FIG. 6) have a higher lead content then the glass cores, they are non-etchable, under the same conditions used to etch the glass cores. Thus, the glass claddings and the support rods remain and become boundaries for the microchannels (microchannels 32 in FIG. 4) formed in the mega-boule wafer. The etching process may be performed by using diluted hydrochloric acid.

Figure 4:
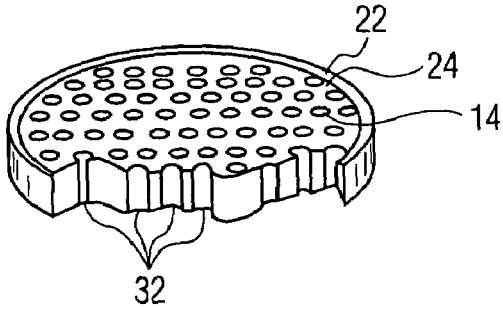
FIG. 4 is a partial cut-away view of a microchannel plate.

The mega-boule wafer is then placed in an atmosphere of hydrogen gas, whereby the lead oxide of the non-etched lead glass is reduced to render claddings 14 as electron emissive. In this way, a semi-conducting layer is formed in each of the glass claddings and this layer extends inwardly from the surface that bounds each microchannel 32 (FIG. 4).

Because support rods 24 become boundaries for each mini-boule 66, the active area of each microchannel plate is decreased. In this way, there are less channels to outgas. Additionally, since each MCP must be made to a predetermined outside diameter, so that it may be accommodated within an image intensifier tube, the area along the rim of each MCP is not used. The area along the rim is blocked by internal structures in the image intensifier tube. Therefore, support rods 24 may form a border of a predetermined area surrounding each mini-boule 66. This border may be the area along the rim of each MCP which is blocked by the internal structures of the image intensifier tube.

Thin metal layers are applied as electrical contacts to each of the planar end surfaces of the mega-boule wafer. This allows the establishment of an electric field across each MCP and provides entrance and exit paths for electrons excited by the electric field.

After activation and metallization, each mega-boule wafer may be connected to a test fixture, whereby each MCP in the mega-boule wafer may be simultaneously tested for proper operation.

If individual dies are required for producing each MCP, the mega-boule wafer may be processed, in step 60, to extract individual MCPs from the mega-boule wafer. The extracting step may be performed by scribing using a laser. The scribing operation should preferably be free from particle generation, in order to minimize contamination of the multiple MCPs.

Advantages of the present invention are many. The shape and size of the monolithic stack may depend on the type of semiconductor wafer fabrication tools available. The shape and size of the mega-boule wafer, which is diced from the monolithic stack, may also depend on the type of semiconductor wafer fabrication tools are available. Consequently, specialized tools may be avoided.

Furthermore, handling and particle defects may be reduced, because the processing tools are automated and limit the amount of human interaction with the MCP dies. Throughput may be increased, because a higher packing density of MCP dies is possible on the mega-boule wafer. This increases the batch size.

Moreover, tool fixture issues for different sizes of MCPs may be easily resolved, because the mega-boule wafer is the fixture that holds the individual MCP dies. Finally, different MCP formats may easily be incorporated into a production line, because the mega-boule wafer is the fixture, and different MCP sizes may be accommodated in a single mega-boule wafer. Peculiar tools for each MCP size may thus be avoided. Although the stacking steps and dicing step may be different for different size requirements of MCPs, the tooling is the same for processing a mega-boule wafer, as a batch die of a predetermined cross-sectional area. This reduces capital costs.

Figure 7:
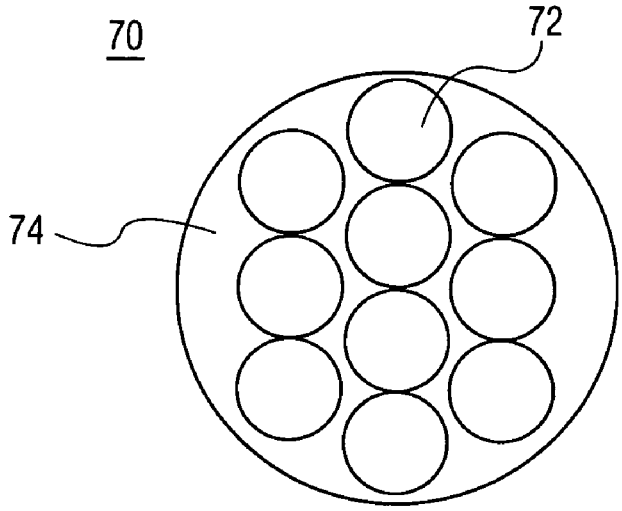
FIG. 7 is a cross-sectional view of a 4-inch semiconductor mega-boule wafer, illustrating that ten standard 18 mm MCPs may be extracted from the batch die, in accordance with the present invention.
Figure 8:
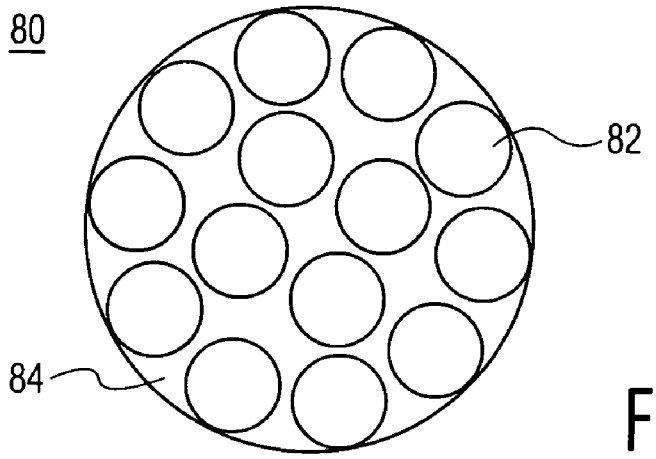
FIG. 8 is a cross-sectional view of a 4-inch semiconductor mega-boule wafer, illustrating that 14 standard 16 mm MCPs may be extracted from the batch die, in accordance with the present invention.

FIGS. 7–9 show different batch sizes for a 4-inch semiconductor mega-boule wafer. FIG. 7 illustrates that ten standard 18 mm MCPs, generally designated as 72, may fit within mega-boule wafer 70. The interstitial area, designated as 74, is the non-etchable glass left after the desired ten MCPs are removed from the 4-inch mega-boule wafer 70.

FIG. 8 illustrates that 14 standard 16 mm MCPs, generally designated as 82, may fit within 4-inch mega-boule wafer 80. The interstitial area, designated as 84, is the non-etchable glass left after the desired 14 MCPs are removed from the 4-inch mega-boule wafer 80.

FIG. 9 illustrates the flexibility of densely packing rectangular MCPs within 4-inch mega-boule wafer 90. As shown, a batch size of 28 MCPs, generally designated as 92, may fit within the 4-inch mega-boule wafer. The non-etchable glass left after the recantangular MCPs are removed is designated as 94. It should be understood, however, that the present invention is not limited to 4-inch mega-boule wafers. Other sizes may be used consistent with semiconductor fabrication tools.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A mega-boule for use in fabricating microchannel plates (MCPs), the mega-boule comprising a cross-sectional surface including at least first, second and third areas, each area occupying a distinct portion of the cross-sectional surface;

the first and second areas including a plurality of optical fibers, transversely oriented to the cross-sectional surface, each optical fiber having a cladding formed of non-etchable material and a core formed of etchable material; and the third area disposed interstitially between and surrounding the first and second areas, the third area formed of non-etchable optical material.

2. The mega-boule of claim 1 wherein the third area includes a plurality of support rods transversely oriented to the cross-sectional surface, and the plurality of optical fibers in the first and second areas and the plurality of support rods in the third area intersect and pass through the cross-sectional surface.

3. The mega-boule of claim 2 further including at least a fourth area, occupying another distinct portion of the cross-sectional surface;

the fourth area including another plurality of optical fibers of similar materials of the optical fibers of the first and second areas; and the third area disposed interstitially between and surrounding the first, second and fourth areas.

4. The mega-boule of claim 2 wherein the echable material of the first and second areas and the non-etchable material of the first, second and third areas are glass, and the non-etchable material includes a higher lead content than the etchable material.

5. The mega-boule of claim 2 wherein the non-etchable optical material of the third area includes a plurality of support rods transversely oriented to the cross-sectional surface, and the optical fibers of the first area and a portion of the plurality of support rods are configured for use as an MCP.

6. The mega-boule of claim 5 wherein the plurality of optical fibers and the plurality of support rods form a fused monolithic stack, when heated and pressed.

7. The mega-boule of claim 2 wherein the plurality of optical fibers of the first and second areas form transverse microchannels in cores of the plurality of optical fibers, when the cores are etched.

8. The mega-boule of claim 2 wherein the first and second areas each forms a rectangular geometry.

9. The mega-boule of claim 2 wherein the cross-sectional surface is of a predetermined area, and the predetermined area is based on accommodating semiconductor wafer fabrication tools.

10. The mega-boule of claim 2 wherein the first and second areas each includes a size corresponding to a size of an active region of an MCP configured as an amplifier for an image intensifier tube.

11. The mega-boule of claim 2 wherein each support rod of the plurality of support rods includes an optical fiber.

12. The mega-boule of claim 2 wherein each support rod of the plurality of support rods includes an optical fiber having a cladding formed of non-etchable material and a core formed of non-etchable material.

13. The mega-boule of claim 2 wherein the first and second areas each forms a circular geometry.

14. The mega-boule of claim 1 wherein the non-etchable optical material of the third area includes a plurality of support rods transversely oriented to the cross-sectional surface, and an optical fiber of the plurality of optical fibers and a support rod of the plurality of support rods have a cross-sectional area similar to each other.

* * * * *